US006138792A

United States Patent [19]

Morris

[11] Patent Number: 6,138,792

[45] **Date of Patent: *Oct. 31, 2000**

[54] PORTABLE CLIMBING APPARATUS

[76] Inventor: Tony M. Morris, 271 Willard Dr., North East, Md. 21901

[ * ] Notice: This patent issued on a continued prosecution application filed under 37 CFR 1.53(d), and is subject to the twenty year patent term provisions of 35 U.S.C. 154(a)(2).

[21] Appl. No.: 08/796,974

[22] Filed: Feb. 7, 1997

[51] Int. Cl.[7] ..... E06C 1/10

[52] U.S. Cl. ..... 182/93; 182/187; 182/178.3

[58] Field of Search ..... 182/93, 116, 187, 182/194, 178.3

[56] References Cited

U.S. PATENT DOCUMENTS

| | | | |
|---|---|---|---|
| 328,637 | 10/1885 | Barr | 182/93 |
| 506,063 | 10/1893 | Nagle | 182/108 X |
| 1,424,115 | 7/1922 | Nileon | 182/198 |
| 2,788,167 | 4/1957 | Morrison | 182/46 |
| 3,630,314 | 12/1971 | Bamburg . | |
| 3,703,939 | 11/1972 | Maxwell . | |
| 4,022,292 | 5/1977 | Van Gompel . | |
| 4,263,983 | 4/1981 | Norton . | |
| 4,376,470 | 3/1983 | Ashton | 182/46 |
| 4,905,792 | 3/1990 | Wilson | 182/178.2 |
| 4,991,690 | 2/1991 | Woller . | |
| 5,040,635 | 8/1991 | Strickland . | |
| 5,105,908 | 4/1992 | Freund | 182/187 X |
| 5,131,495 | 7/1992 | Bartnickl | 182/46 |
| 5,242,030 | 9/1993 | Lobozzo . | |
| 5,355,974 | 10/1994 | Miller | 182/187 |
| 5,427,198 | 6/1995 | Walsh | 182/46 |
| 5,439,072 | 8/1995 | Jenkins, Jr. . | |
| 5,507,362 | 4/1996 | Krueger | 182/187 |
| 5,509,499 | 4/1996 | Prejean . | |
| 5,515,942 | 5/1996 | Woodfield | 182/46 |

FOREIGN PATENT DOCUMENTS

| | | | |
|---|---|---|---|
| 1313696 | 11/1962 | France | 182/93 |
| 356886 | 10/1961 | Switzerland | 182/93 |

*Primary Examiner*—Alvin Chin-Shue
*Attorney, Agent, or Firm*—Huntley & Associates

[57] ABSTRACT

A portable climbing apparatus comprising segments which can be stacked end to end to form a ladder and which can be nested together for easy transportation.

12 Claims, 10 Drawing Sheets

PORTABLE CLIMBING APPARATUS

BACKGROUND OF THE INVENTION

The present invention relates generally to a portable climbing apparatus and more specifically to a portable apparatus that can be assembled to form a ladder. The apparatus, when assembled to form a ladder, is useful for climbing a wide variety of objects, especially trees. Because the apparatus can be easily transported, it is especially useful for hunters, forest rangers, and in the care of trees.

Typically, a hunter will use a tree stand to wait for passing game. The tree stand offers the hunter an improved vantage point from which to view approaching game, a means of becoming less visible, and a more comfortable place to wait. Because it is often difficult to climb a tree to install and get into the tree stand, especially given the fact that the hunter may be carrying heavy and bulky equipment, a ladder is typically used. Due to the fact that hunting is typically an activity best performed far from any people, buildings, or roads, the ladder must be portable.

Prior portable ladders did not address the problem of noise. Some previously disclosed ladders are made portable by wheels, but the wheels can make noise and scare away any game animals. Other portable ladders can be transported on the back of the hunter, but these devices are noisy to transport and assemble. More problematic than the noise, the presently available ladders are either cumbersome or difficult to assemble. Accordingly, there is an unmet need for a portable ladder that can be transported easily and quietly, that can be set up quickly, easily, and quietly, and that can provide a means of climbing a tree. In addition, there is a continuing need for a portable ladder that can be used on a wide variety of trees, due to the fact that trees vary in configuration, size, and dimensions. Most previous disclosures regarding climbing devices failed to suggest a solution to the problem of tree limbs and irregularly shaped tree trunks which can block a rigid vertical ladder. In addition, due to an increased concern for the environment, there is a need for an apparatus that accomplishes the above without causing significant damage to the tree.

SUMMARY OF THE INVENTION

The present invention provides a portable climbing apparatus that can be assembled to form a ladder. The apparatus can be easily transported in a stacked or nested mode, and can be quickly and quietly assembled into a ladder which can be connected to a tree or other object to be climbed and which provides a means of compensating for differences in tree configuration without significantly damaging the tree.

Specifically, the present invention provides a portable climbing apparatus comprising at least two segments which are adapted to be operatively connected together to form a ladder, each segment comprising at least one longitudinal member, a plurality of transverse members, and a multiplicity of contact points extending from the segment toward an object to be climbed, wherein each transverse member is affixed at spaced intervals to the at least one longitudinal member to form a series of rungs, and each longitudinal member has at least one mating end adapted to connect the segments together, and wherein the apparatus has at least one securing means adapted to connect the ladder to the object to be climbed.

Preferred embodiments of the invention can form an elastically deformable ladder which can be twisted or bent to conform to the contours of a crooked tree trunk, thus providing a ladder that can be adapted for use with a wide variety of objects to be climbed. The individual segments of the climbing apparatus will return to their original shape after being deformed, thus remaining portable and easily stored. The preferred elastically deformable embodiments are especially useful for climbing trees. Because the trunk of each tree can vary in orientation and configuration, and due to the fact that each tree has branches of different orientation, dimensions, and configuration, the preferred embodiment of the present invention can be used as a means of climbing a wide variety of trees.

DETAILED DESCRIPTION OF THE INVENTION

The present invention will be more fully understood by reference to the drawings, which show one possible embodiment of a climbing apparatus of the present invention. Variations and modifications of this embodiment can be substituted without departing from the principles of the invention, as will be evident to those skilled in the art.

Figure 1:
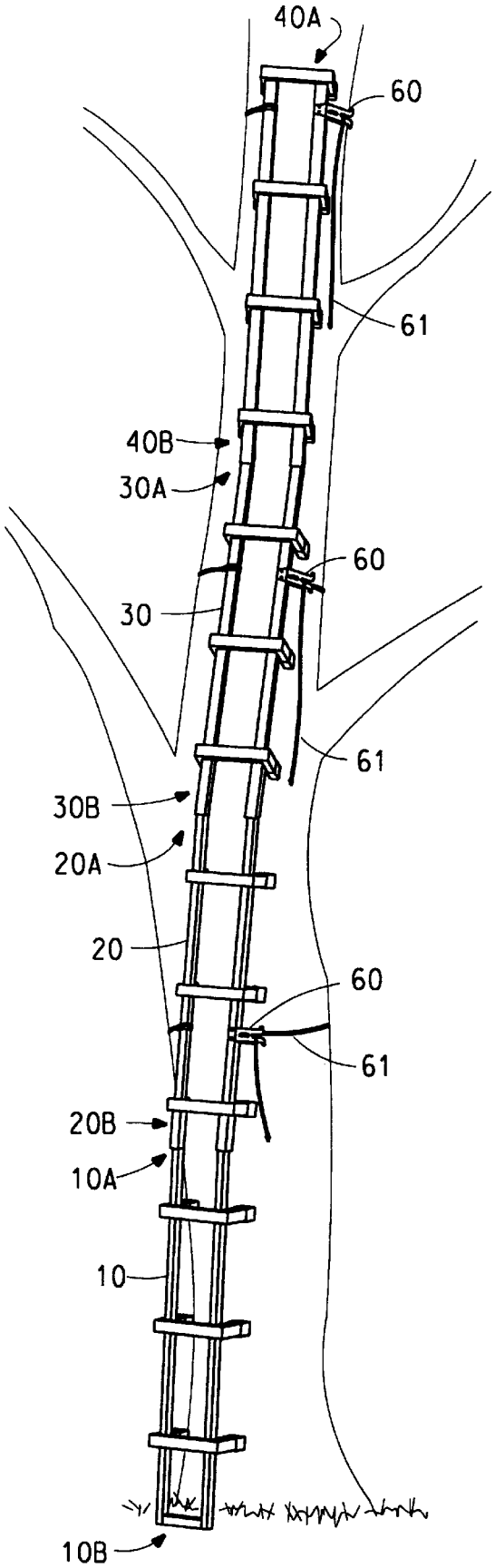
FIG. 1 is a side elevational view of a first embodiment of a ladder of the present invention attached to a tree.
Figure 3:
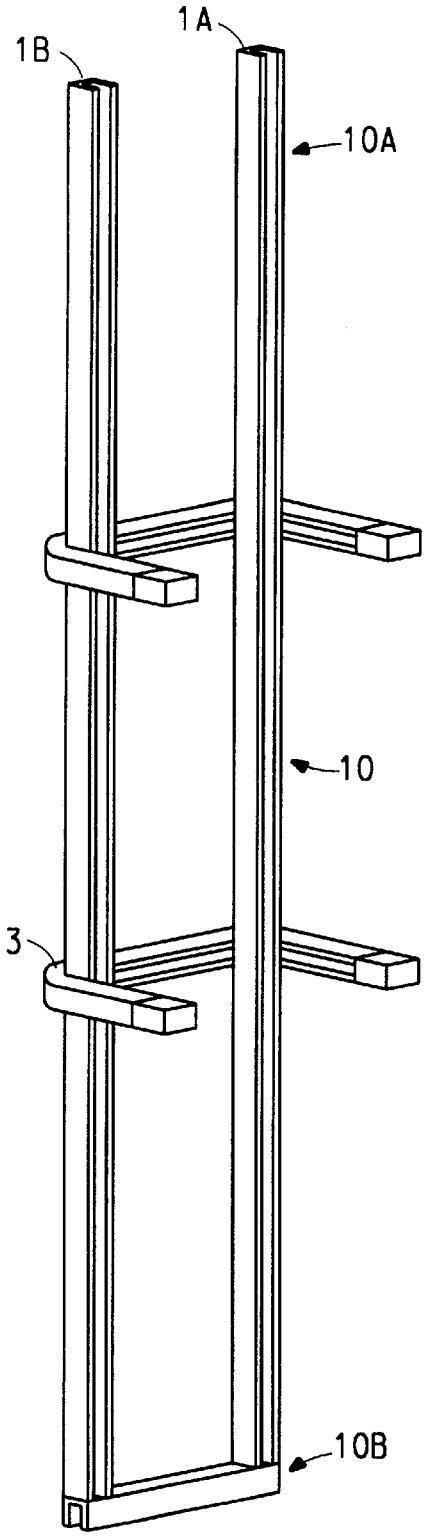
FIG. 3 is a perspective view of a first or bottom segment of the ladder of FIG. 1.
Figure 4:
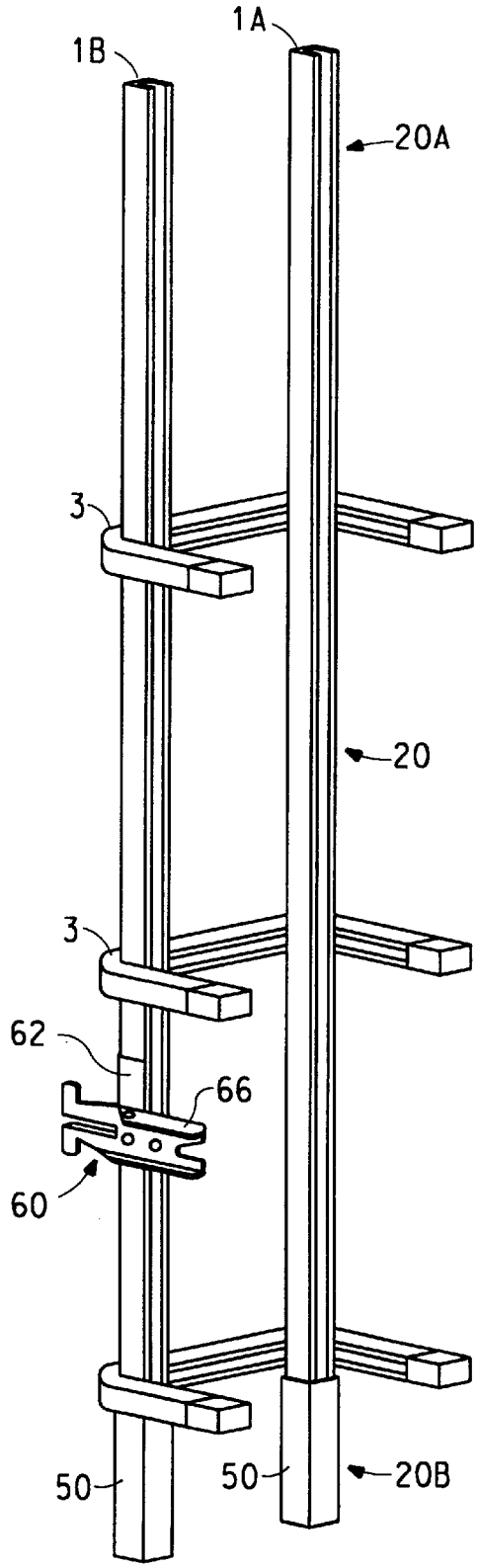
FIG. 4 is a perspective view of a second segment of the ladder of FIG. 1.
Figure 5:
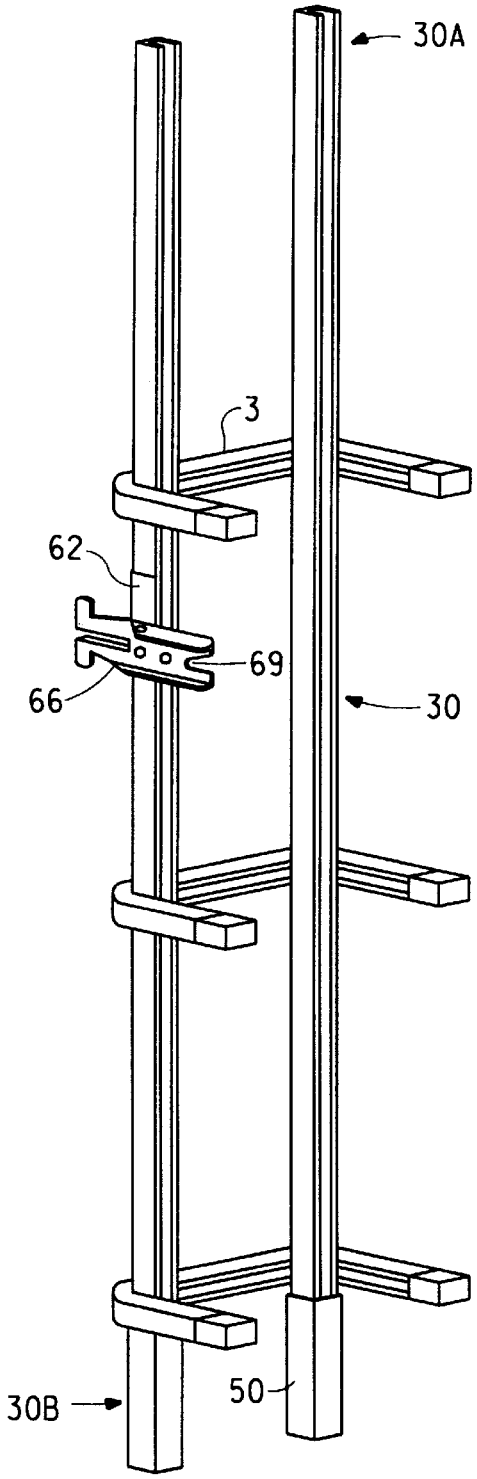
FIG. 5 is a perspective view of a third segment of the ladder of FIG. 1.
Figure 6:
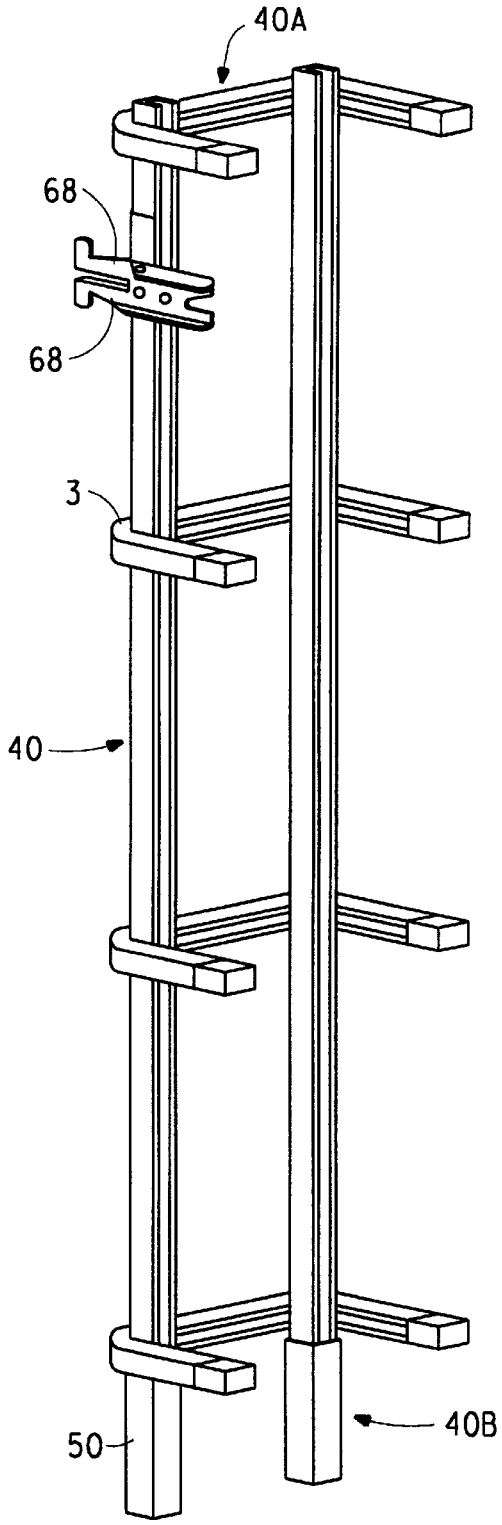
FIG. 6 is a perspective view of a fourth or top segment of the ladder of FIG. 1.

In FIG. 1, a first embodiment of an apparatus of the present invention is shown, wherein the segments have been connected to form a ladder. The embodiment of the apparatus shown comprises four segments which are joined to form a single ladder. Each segment has an upper and lower end. A first segment 10, also shown in FIG. 3, has a base 10B at its lower end which is shown in FIG. 1 resting on the ground. The upper end 10A of the first segment is adapted to mate with the lower end 20B of a second segment 20, also shown in FIG. 4. Both the upper and lower ends 20A and 20B, respectively, of the second segment 20 are adapted to mate with an end of another segment, and the upper end 20A of the second segment is shown operatively connected to the lower end 30B of a third segment 30, also shown in FIG. 5. Both ends of the third segment are similarly adapted to mate with an end of another segment, and the lower end 30B of the third segment is shown operatively connected to the upper end 20A of the second segment 20. At the upper end 30A of the third segment a fourth segment 40, also shown in FIG. 6, is operatively connected. The fourth segment is adapted to mate with a segment at its lower end 40B, where it is shown operatively connected to the upper end 30A of the third segment. At the upper end 40A of the fourth segment a transverse member is connected to each longitudinal member.

Alternate embodiments of the present invention include a foldable apparatus having segments which can be unfolded and extended to operatively connect end to end to form a ladder, or which can be folded into the nested or stacked position for transportation or storage.

Each segment of the ladder shown in FIGS. 1–6 comprises two substantially parallel longitudinal members, 1A and 1B, respectively. Alternate embodiments include segments with a single longitudinal member or segments with three longitudinal members. In embodiments having a single longitudinal member, the ladder is climbed by placing the feet on transverse members on either side of the longitudinal member. In embodiments having three longitudinal members, the feet are placed on transverse members on either side of a central longitudinal member and between the remaining two longitudinal members.

Figure 7:
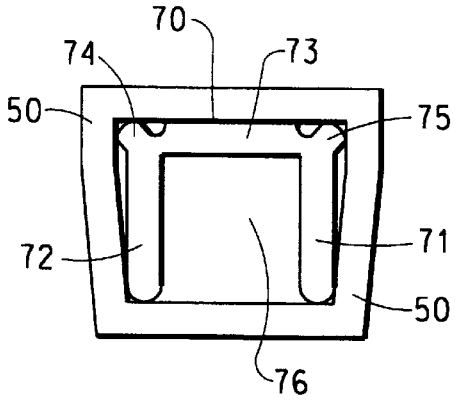
FIG. 7 is a bottom plan view of a mating means of a longitudinal member of the segment of FIG. 6.
Figure 9:
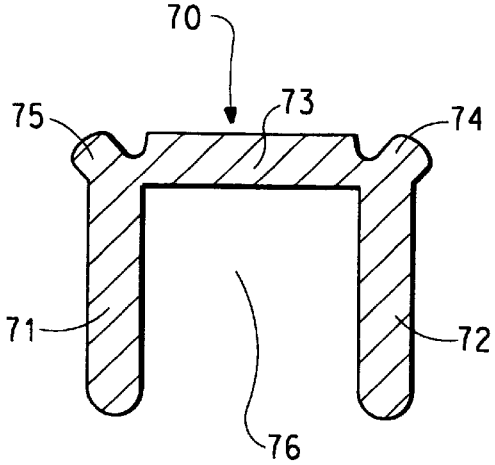
FIG. 9 is a cross sectional view of a typical longitudinal or transverse member of an apparatus of the invention.

As shown in FIGS. 1–6, the first and fourth segments each have one mating end, while the second and third segments each have two mating ends. The mating ends are located on the longitudinal members of each segment. Segments are connected at their respective mating ends to form a ladder. Preferably, the segments are held in the mated position by coupling means. In the embodiment shown, the second, third and fourth segments are provided with coupling means 50 on their respective lower ends, 20B, 30B, and 40B. The coupling means can be manufactured from a wide variety of materials, and in a wide variety of configurations. In alternate embodiments, they can be sleeves which are not affixed to any one segment. In the embodiment shown, the coupling means are hollow rails having polygonal cross sections manufactured from extruded aluminum. Each coupling means is adapted to fit over a mating end of a longitudinal segment at each end, and as shown in FIG. 7, the polygonal cross section of the coupling means is adapted to fit over the preferred longitudinal member, which, as shown in FIG. 9, has a substantially "pi' shaped cross section.

Rungs are formed on each segment where transverse members 3 are connected to both longitudinal members. The transverse members define the distance between the longitudinal members, and the rung portion of each transverse member is between the longitudinal members. Preferably, the distance between longitudinal members is at least about three inches to allow for a rung portion of suitable width to allow a boot to be placed thereon. The distance between longitudinal members should be sufficient to allow even the largest cold weather boot to be placed on the transverse member without being restricted by contact with either longitudinal member. In addition, the width of the rung should not be so great as to allow for lateral movement of a climber's boot. Accordingly, the exact dimensions of the present invention will vary depending on the embodiment of the apparatus, and the foot size of the climber for which it was adapted.

In the embodiment shown, the multiplicity of contact points extending from the segment toward an object to be climbed are formed on each transverse member. In alternate embodiments, the contact points can be formed on each longitudinal member at or between each transverse member. In addition to forming a rung and uniting the two longitudinal members to form a segment, each transverse member shown comprises two substantially parallel ends, 3A and 3B, which extend in a substantially perpendicular direction from the rung portion and the longitudinal member. Each end of each transverse section is adapted to contact the tree or other object to be climbed, and should extend a sufficient distance from the rung portion and longitudinal member to provide enough clearance between the segment and the tree to allow for the front of a climber's boot to extend towards the tree beyond the rung portion. If the clearance between the segment and the object to be climbed is less than about three inches, the climber will be forced to climb the assembled ladder by placing only the toes of each boot on the rung portion, and thus will be less safe than where the clearance is sufficient to allow the ball of the climbers foot to be placed on the rung portion. Again, the dimensions will vary according to the specific needs of the climber, and may also depend on the effect variations in tree trunk diameter will have on the amount of space available for a climber's foot. For example, a tree having a more narrow diameter will reduce the clearance available between the rungs and the tree.

Figure 2:
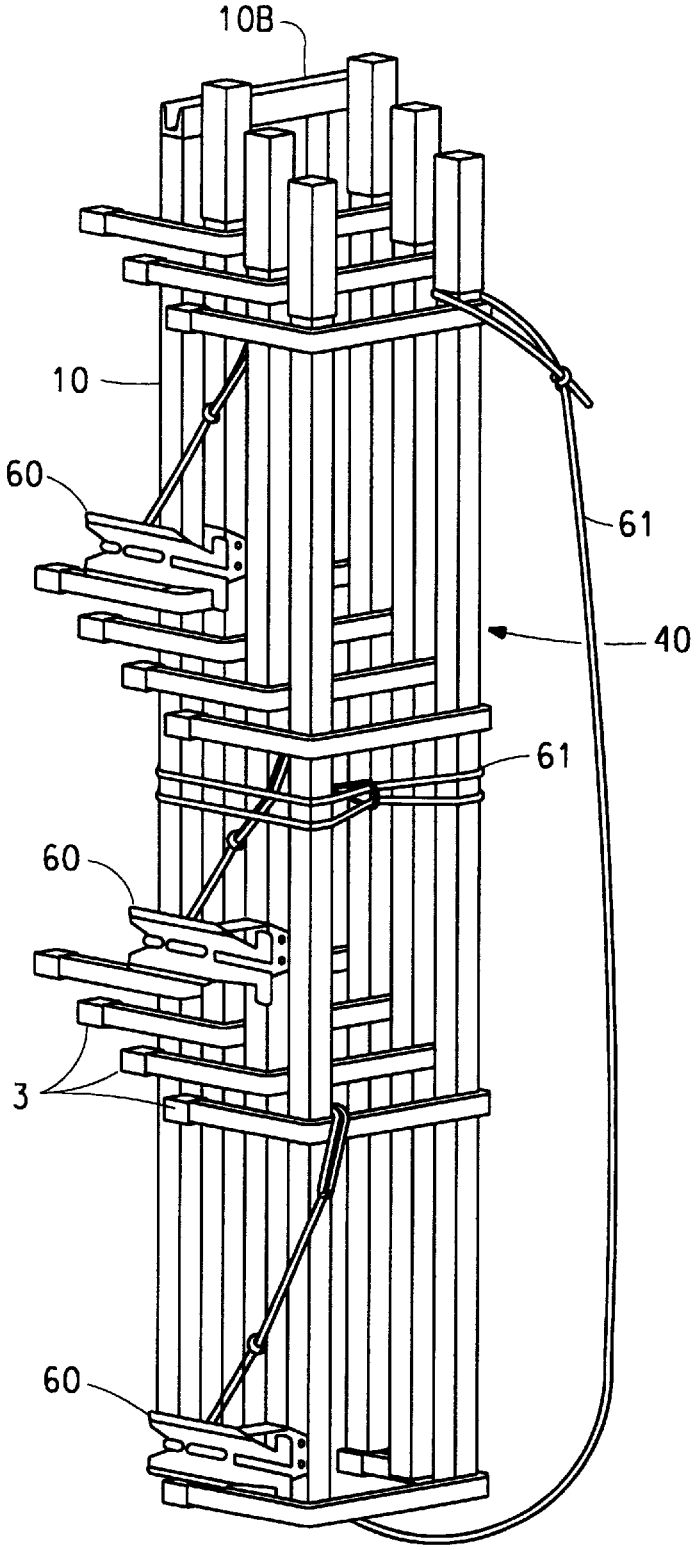
FIG. 2 is a perspective view of the segments of the ladder of FIG. 1 in the nested position.

In the embodiment shown, all members are similarly oriented. More specifically, the extruded rails which form the longitudinal and transverse members are all connected so that the legs of the "pi" shaped rails all point in the same direction, towards the object to be climbed. The transverse members are roughly "U" shaped, and are affixed to the longitudinal members at the bending point or junction of the rung portion and the extension portion of the transverse member. The longitudinal members are each attached to the inside of the "U" shape in order to provide greater strength and flexibility, as well as to provide segments which will nest together, as shown in FIG. 2 and discussed below. In the embodiment shown, the members are welded together a method commonly referred to as metal inert gas welding.

Figure 8:
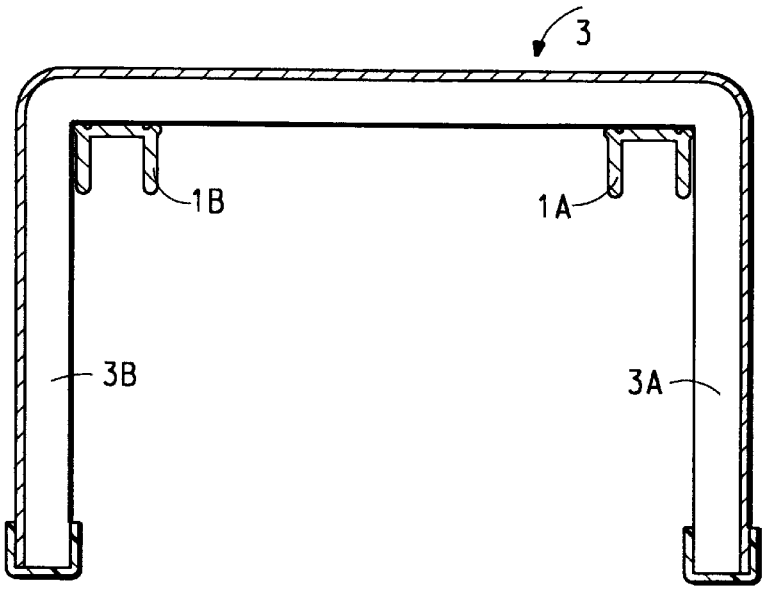
FIG. 8 is a typical cross sectional view of a segment of the ladder of FIG. 1 taken along a line drawn through a cross section of a transverse member.

Both the transverse members and the longitudinal members can be fabricated from a wide variety of materials, and in a wide variety of configurations. Suitable materials include, but are not limited to, plastics, resins, fibrous resins, nylon, fiber reinforced plastics, fiberglass, titanium, and composite materials. For strength, flexibility, elasticity, and resistance to corrosion, the preferred members are heat treated temper extruded aluminum (Commercially available under the designation 6061-T6). The aluminum can be extruded into rails, and in the preferred embodiment shown, the rails have "pi" shaped cross sections, as shown in FIG. 8. Alternate cross sectional configurations include, but are not limited to, modified "U, " "H," or "T" shapes.

The preferred "pi" shaped cross section 70 generally comprises two substantially parallel segments, 71 and 72, connected by a substantially transverse segment 73. The modification to the "pi" shape shown comprises two tabs, 74 and 75, which extend along a line that bisects the angle formed where each parallel segment connects with the transverse segment. The preferred "pi" shaped cross section offers flexibility, strength, and the modification to the "pi" shape provides cleaning edges to remove ice, snow, dirt, from the sole of the boot as the boot is placed on the rung. In addition, the area 76 between the parallel segments of the "pi" shaped cross section may be filled with a lightweight, elastically deformable noise reducing material to reduce any noise associated with transporting or assembling the ladder. Suitable noise reducing materials include, but are not limited to, silicone, plastic, urethane, foam, fibrous material, cellulose, or other lightweight material capable of remaining affixed to the insides of the rail while elastically flexing as the rail flexes.

Figure 10:
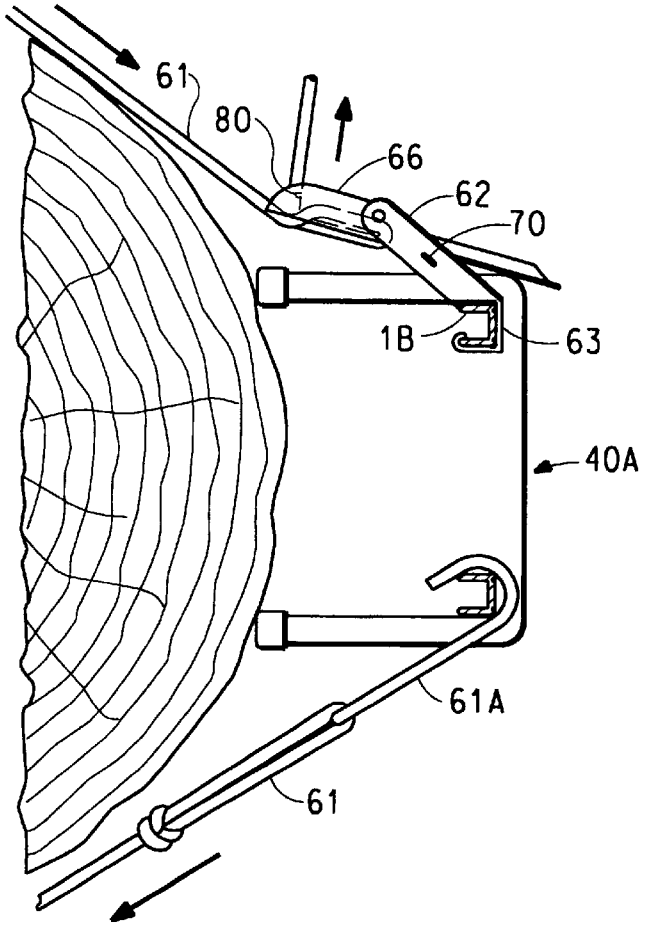
FIG. 10 is a view of the ladder of FIG. 1 showing a top plan view of the top of the fourth segment of FIG. 6 shown attached to the tree, which has been partially cut away for clarity.
Figure 11:
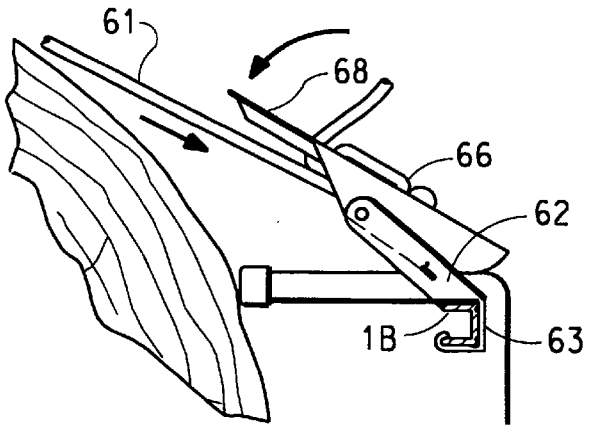
FIG. 11 is a top plan view of a portion of FIG. 10 showing the securing means in the tensioned position.
Figure 12:
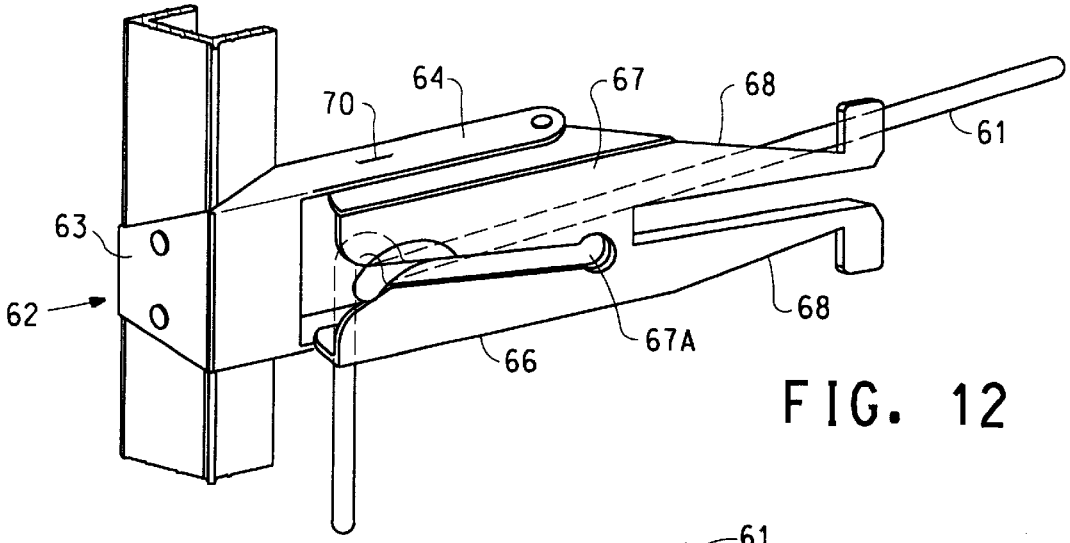
FIG. 12 is a perspective view of a securing means of the present invention.
Figure 13:
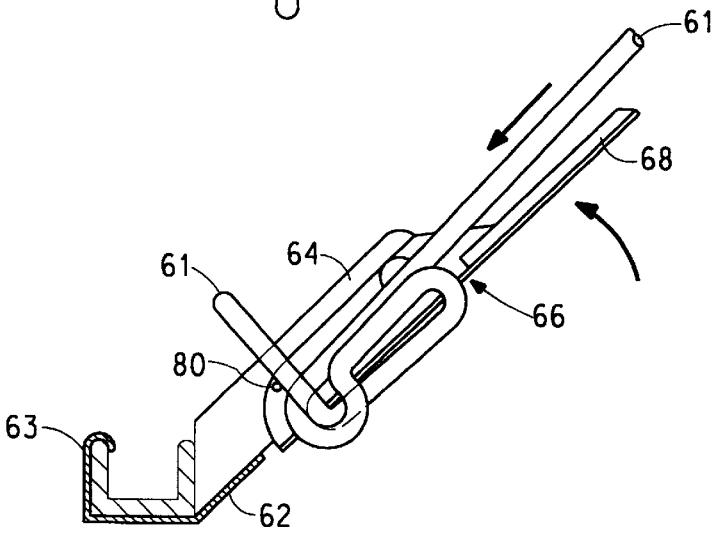
FIG. 13 is a perspective view of a securing means of the present invention.
Figure 14:
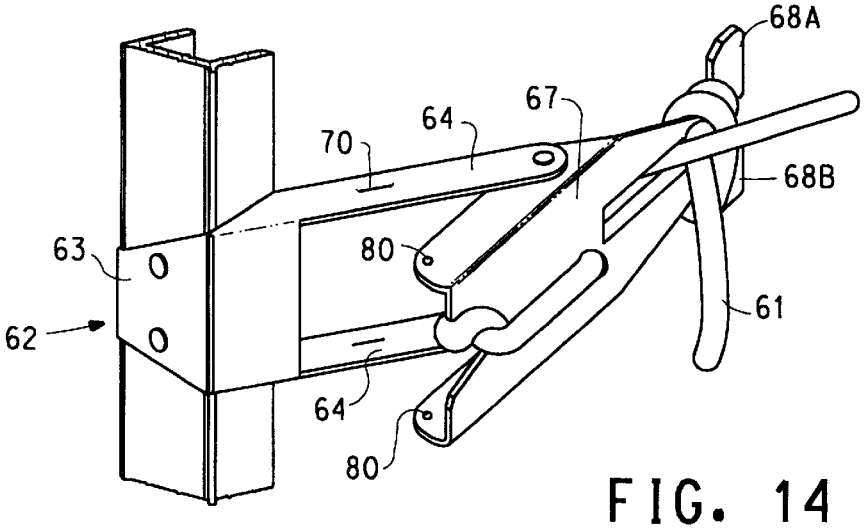
FIG. 14 is a perspective view of a securing means of the present invention.
Figure 15:
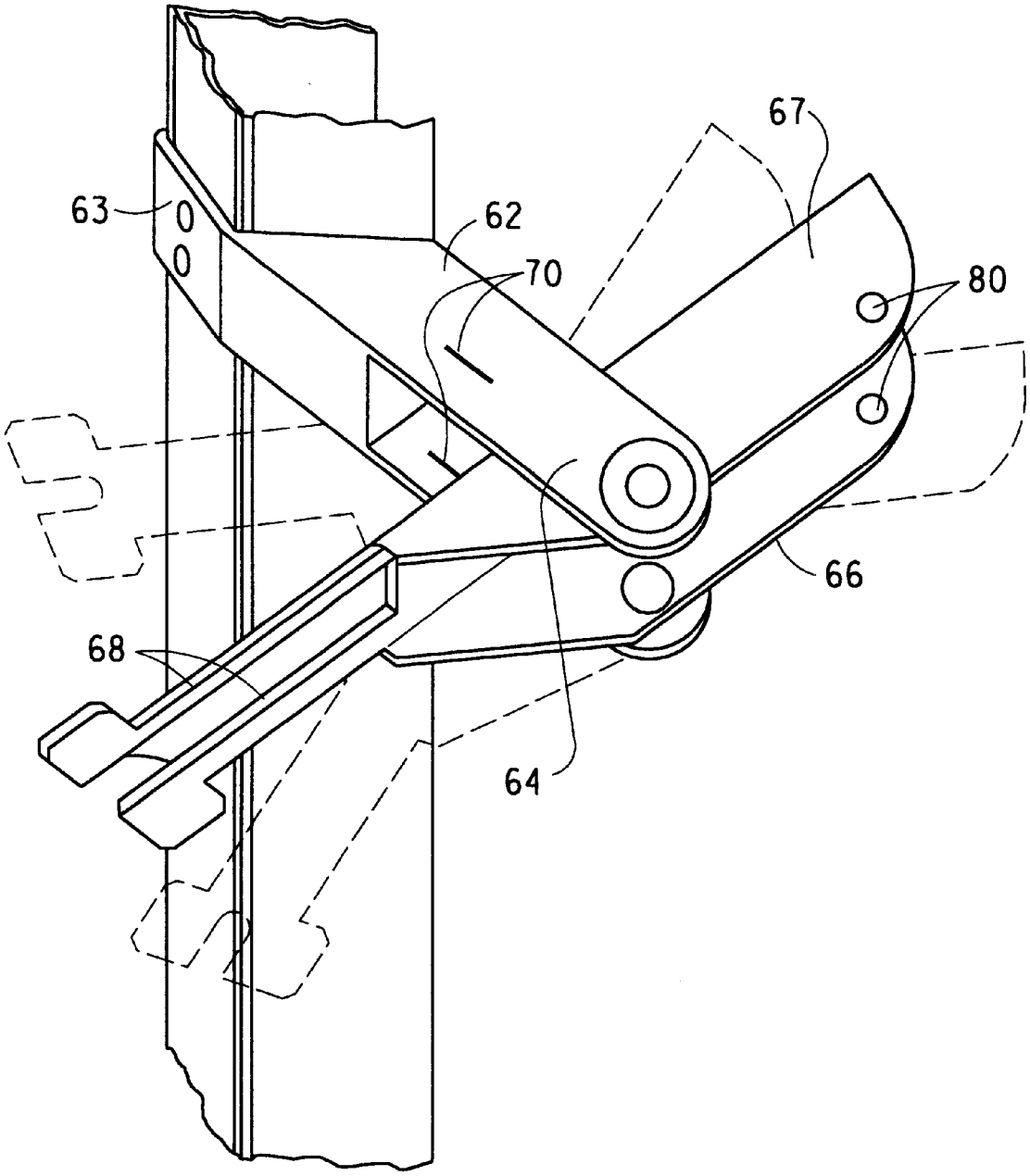
FIG. 15 is a perspective view of a binder mount and binder of the present invention, with the binder drawn in phantom outline to show several possible positions.

In FIGS. 1, 10, and 11, the apparatus is shown connected to form a ladder, which is shown attached to a tree. Due to the configuration of the tree, the apparatus shown in FIG. 1 is substantially vertically oriented. Because trees vary in configuration, each segment of the apparatus is elastically deformable, so that when joined together the segments form a ladder that can flex and then return to its original shape. By providing a flexible and elastic ladder, the present apparatus provides a means for the ladder to be torqued around or along the trunk of a tree to maintain as many contact points as possible with the tree while avoiding contact with branches. The elastically deformable embodiment shown provides a means for compensating for crooked tree trunks and other irregularities. As shown in FIG. 1, the ladder can be torqued around or bent along the contours of the tree while multiple contact points at the ends of each transverse member serve to transfer the weight of the climber to the tree instead of down the longitudinal members, thus providing added support for the climber even when the ladder is flexed, and also provided added grip as the ends of each segment are forced into contact with the tree. By providing multiple contact points, the present apparatus can form a ladder that can be more securely affixed to a tree. The multiple contact points also provide added support which permits the ladder to be torqued, flexed, or bent while still providing support to a climber by maintaining contact with the object to be climbed along as many transverse segment ends as possible. The ability of the ladder to elastically flex permits it to be used with a wide variety of trees, while still being capable of returning to its original shape for stacking and transporting.

To further assure that the ladder is able to maintain contact with the tree at as many points as possible, the upper three segments shown in FIGS. 1–6 are each provided with a preferred embodiment of a securing means of the present invention. As shown in FIGS. 1–6, 10 and 11, the second, third and fourth segments of the ladder are each provided with securing means 60, which in the embodiment shown, comprise a rope 61 and a binder assembly. As shown in FIGS. 1–6, and 10–17, the preferred binder assembly comprises a binder mount 62 which is affixed to a longitudinal member and a binder 66 which is pivotally mounted to the binder mount. The rope and binder provide a means of securing the ladder in contact with the tree, and also provide a means of securing the individual segments together in a nested position which can be easily transported. FIG. 2 shows the segments of the ladder of FIG. 1 secured in the nested position by the preferred securing means.

The securing means are adapted to provide a means of quickly and easily affixing the ladder to the tree, and after the rope is wrapped around the tree and secured to the segment, the binder can be can be operated with one hand to tension and secure the rope around the tree. Because the climber can reach the securing means of the second segment without standing on the first segment, the securing means of the second segment provides an easy way to secure the first two segments, without requiring the climber to stand on either segment. While a climber's feet are at or below the securing means of the second segment, the climber can reach the securing means of the next segment without standing or leaning on that unsecured segment. Typically, the securing means are spaced about from 4 to 5.5 feet apart, and can thus be reached from the ground or from a position on a secured segment that will not induce the ladder segments to pivot about the securing means. For safety purposes, it is desirable to prevent situations where a climber's weight is placed significantly above the securing means before an upper segment is secured.

Preferably, the binder mount and binder are pivotally connected to each other. The binder assembly of the securing means shown can be fabricated from a wide variety of materials having suitable strength, rigidity, resistance to corrosion, and ability to be camouflaged. Suitable materials include, but are not limited to, aluminum, steel, fiber reinforced plastic, and composite materials. The binder assembly is subjected to considerable force when used to tighten the rope and secure the segment to a tree, and thus should be made of a material that provides strength and resists deformation. The binder mount and binder shown are made from galvannealed steel, which provides strength, rigidity, and resists corrosion. In addition, galvannealed steel is easily painted, and has a flat finish, thus providing an easily camouflaged surface.

The binder mount 62 is adapted to be affixed to a longitudinal member, and in the embodiment shown, the binder mount comprises an extension 63 adapted to wrap around a portion of the longitudinal member, where it can be bolted or otherwise securely affixed to the member. The binder mount further comprises two substantially parallel tabs 64 at an end opposite the extension. The binder mount, when affixed to a longitudinal member, extends away from the member to which it is affixed towards the end having tabs.

The binder 66 comprises a body 67 and two ends. Two apertures, 67A and 67B, formed in the body are preferably not aligned with the longitudinal axis of the binder. At one end of the binder is an extension with two tangs 68 separated by a central slot. Each tang has a terminal end 68A and 68B extending away from the body, each terminal end being substantially perpendicular to the tang from which it extends. At the other end of the binder a niche 69 is formed. The binder is adapted to be pivotally mounted to the binder mount at a point between the body and the central slot, so that the end of the binder having the extension faces away from the segment, and the end having the niche faces towards the segment, depending upon the position to which the binder has been pivoted.

The binder shown is pivotally mounted by rivets to the binder mount near the terminal end of each tab of the binder mount. Riveting is only one possible means of pivotally connecting the binder to the binder mount. Each tab further comprises opposing inwardly extending depressions for mounting the binder so that the binder does not contact either tab while it is pivoted. Preferably, both the binder mount and binder have opposing tabs 70 and 80 adapted to resist the pivoting motion of the binder when the tabs interact, so that the climber can gauge the position of the binder relative to the binder mount without looking at the assembly. The binder mount and binder work in conjunction with a rope to connect segments to the object to be climbed.

The rope has a first end adapted to be connected to the binder and a second end having a grasping means such as a hook 61A adapted to connect the second end to a longitudinal member. The rope can be fabricated from a wide variety of materials. In the embodiment shown, the ropes are high strength low stretch solid braided polyester with 2670 pound test and 375 pound work load rating. The rope can also be provided with a cable style crimped loop for attachment to the hook. Preferably, the hook is rubber coated to reduce any noise associated with the hook contacting another part of the ladder during transportation and assembly.

Figure 16:
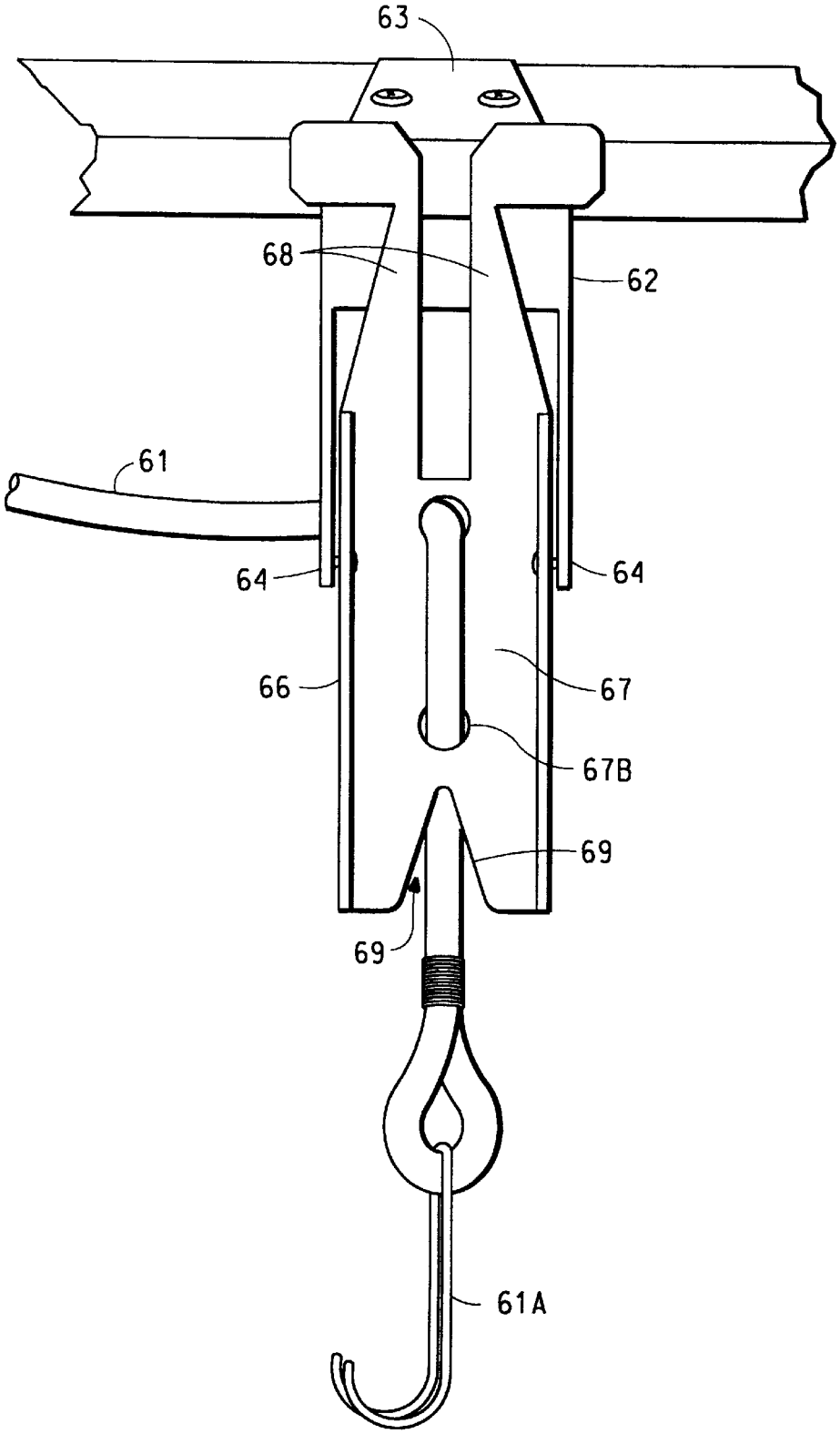
FIG. 16 is a perspective view of a securing means of the present invention, showing the binder in the untensioned position.
Figure 17:
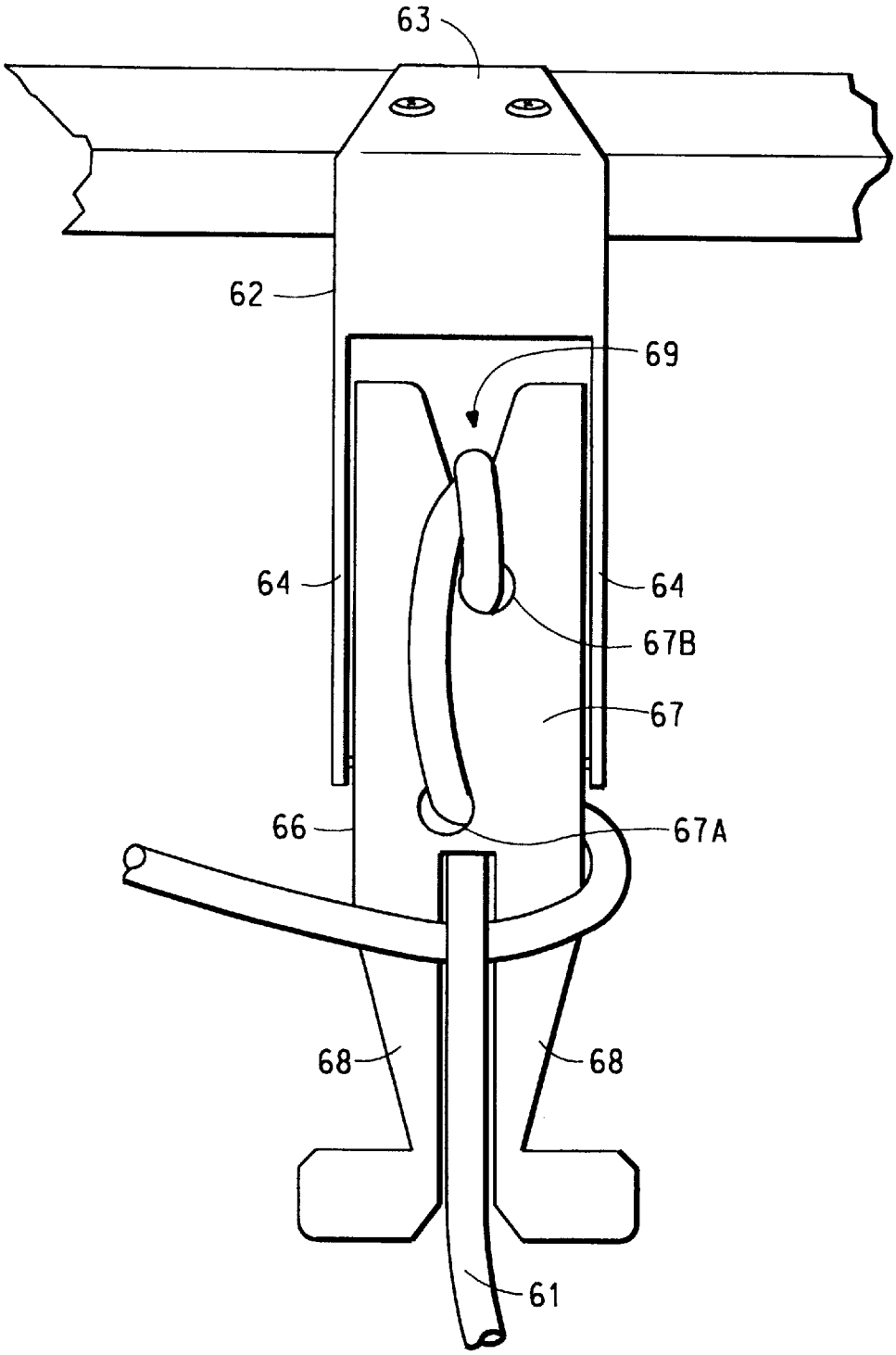
FIG. 17 is a perspective view of a securing means of the present invention, showing the binder in the tensioned position.

The preferred securing means shown comprises a rope with a free end and an end having a hook or other grasping means, and a binder assembly comprising the binder mount and binder. The binder mount is shown affixed to a longitudinal member, and the binder is pivotally attached to the binder mount between the two tabs of the binder mount. To use the binder assembly and rope, the free end of the rope is threaded through the two apertures in the binder so that it is closest to the tangs at one end of the binder, as shown in FIG. 16. The hook end of the rope is then wrapped around a tree and connected to a longitudinal member. Once the hook is secured, the free end of the rope is pulled to eliminate any slack. With the rope tautly wrapped around the tree, any remaining slack is removed by pulling the free end of the rope. The free end is then pulled towards a niche formed in the end of the binder opposite the tangs. Once pulled through the niche, the loose end of the rope contacts the end of the rope having the hook, and secures the rope in position within the binder. To further secure the rope in position and secure the segment to the tree, the binder is pivoted towards the tree, tensioning the rope, until the hook end of the rope is positioned within the slot between the two tangs of the binder, whereupon the loose end may be pulled through the tangs behind the hook end to secure the hook end in place. The free end can then be wrapped between and around the tangs, in much the same way that a rope is tied to a cleat to secure a boat to a dock, to further secure the hook end tautly around the tree. In many hunting situations, it is desirable to wrap all slack around the binder, so that the free end of the rope does not dangle or otherwise draw attention to the ladder or the climber. By pushing the binder forward into the locked position, the rope is further tightened around the tree as the binder acts as a tensioning lever, providing mechanical assistance to the climber in tightening and securing the segment. Due to the design of the binder, any force on the rope that would tend to pull the segment away from the tree or otherwise loosen the rope will not result in the binder moving from the locked position, even if the ropes have not been further secured through the tangs.

FIG. 2 shows the four segments of the ladder of FIG. 1 in the nested position. The segments are lashed together in the nested position by the rope of the securing means of any one of the three segments so provided. Either of the two remaining securing means can then be used as a shoulder strap for carrying the nested segments.

Alternate securing means can be used in the present invention, including, but not limited to traditional climbing gear, a rope having a hook, a hook and eyelet with rope, a strap and buckle or clamp, ratchet straps, cinch straps, and other known means. Wire, cable, or rubber cords can be substituted for the rope, in addition to straps made from woven material or plastic strips. Preferably, the securing means will not damage a tree, but the ladder can be secured by less environmentally favored means such as spiking or screwing it into the tree.

The apparatus of the present invention provides a desirable combination of advantages. Because the apparatus is lightweight and the segments of the apparatus can be secured in the nested position, it can be easily transported. The segments can be provided with sound reducing means or treatments, such as rubber coating, or foam filling each member, thus providing the additional advantage of reduced noise while transporting, assembling, and climbing. Ease of transportation is of great importance when the tree stand is in a remote area, and such a location is desirable due to the fact that most game animals shy away from human activity and most hunting is restricted to remote areas. Similarly, when traveling to a hunting area, it is desirable to minimize any noise, especially metallic or machine noises that are foreign to most remote hunting areas.

The flexibility of the longitudinal members permits the ladder to conform to the trunk of a tree or other object to be climbed, and provides a means for maximum contact between as many ends of the transverse members and the tree as possible. The top end of the ladder of the present invention can be twisted up to about 90° around the trunk of a tree, measured from the base of the bottom segment to the top of the fourth segment. The assembled ladder is elastically deformable to positions which resemble a double helix, and can also be bent to conform to the contours of an object to be climbed, while still remaining secured to the object and while providing sufficient support to safely suspend two hunters. The ladder can also flex along the contours of a crooked tree. The amount of flex or torsion is determined by the materials used to fabricate the members, their configuration, and the length of the ladder, among other things. The amount of flex is also related to the ability of the material chosen to return to its original shape. Once removed from the tree, the ladder and each segment will return to their original shape.

What is claimed is:

1. A portable climbing apparatus comprising at least two segments which are adapted to be operatively connected together to form an elastically deformable ladder, each segment comprising at least one elastically deformable longitudinal member, a plurality of transverse members, and a multiplicity of contact points extending from the segment toward an object to be climbed, wherein each transverse member is affixed at spaced intervals to the at least one longitudinal member to form a series of rungs, and each longitudinal member has at least one mating end adapted to connect the segments together and coupling sleeves adapted to fit over the mating ends of the at least one longitudinal member of two segments to operatively connect the segments, and wherein the apparatus has at least one securing means adapted to connect the ladder to the object to be climbed, and wherein the at least one securing means comprises a rope and a binder assembly, the binder assembly comprises a binder mount and a binder, wherein the binder mount is attached to the at least one longitudinal member and the binder is pivotally attached to the binder mount, and wherein the rope has a first end attached to the binder and a second end adapted to be wrapped around an object to be climbed and secured to the at least one longitudinal member, and wherein the binder is adapted to pivot to tension and secure the rope, and wherein the binder comprises a first end having a niche formed therein, a body with two apertures formed therein, and a second end with an extension formed by two tangs separated by a central slot, and wherein the number of securing means is one less than the number of segments.

2. An apparatus of claim 1 wherein the binder is pivotally mounted to the binder mount at a point between the body and the central slot.

3. An apparatus of claim 2 wherein each tang has a terminal end extending away from the body, each terminal end being substantially perpendicular to the tang from which it extends.

4. An apparatus of claim 1 wherein each segment comprises two substantially parallel longitudinal members.

5. An apparatus of claim 1 wherein the transverse members have a central portion which forms a rung and two ends which are substantially perpendicular to the rung.

6. An apparatus of claim 5 wherein the ends of the transverse members form the multiplicity of contact points.

7. An apparatus of claim 1 wherein a first segment is provided with a base substantially perpendicular to the at least one longitudinal member of the segment at a lower end thereof, wherein the base is adapted to rest on the ground.

8. An apparatus of claim 1 wherein the segments are adaptable to nest together when not operativley connected to form a package of substantially the same dimensions as a single segment.

9. An apparatus of claim 1 wherein the at least one securing means is further adaptable to secure the segments in the nested position.

10. An apparatus of claim 1 comprising a first and a second securing means, wherein the first securing means is adaptable to secure the segments in the nested position and the second securing means is adaptable to be used as a carrying strap, permitting the nested segments to be transported as a unit.

11. An apparatus of claim 1 wherein the cross section of each member comprises two substantially parallel members connected by a substantially transverse member.

12. An apparatus of claim 11 wherein the area between the two substantially parallel members of the cross section is at least partially filled with an elastically adaptable noise reducing material.

* * * * *